United States Patent [19]

Hughes et al.

[11] Patent Number: 4,508,411

[45] Date of Patent: Apr. 2, 1985

[54] WIRE STUFFING COVER

[75] Inventors: Richard L. Hughes; Ned A. Sigmon, both of Clemmons, N.C.

[73] Assignee: AMP Incorporated, Harrisburg, Pa.

[21] Appl. No.: 480,044

[22] Filed: Mar. 29, 1983

[51] Int. Cl.[3] ..... H01R 11/20; H01R 13/58

[52] U.S. Cl. ..... 339/99 R; 339/97 P; 339/103 M; 339/108 R; 339/198 J

[58] Field of Search ..... 339/97 R, 97 P, 98, 339/99 R, 198 J, 108 R, 103 R, 103 M, 105, 107

[56] References Cited

U.S. PATENT DOCUMENTS

| | | | |
|---|---|---|---|
| 3,427,553 | 2/1969 | Smulowitz | 339/103 R X |
| 3,976,350 | 8/1976 | Keglewitsch | 339/97 P |
| 4,186,984 | 2/1980 | Reavis, Jr. et al. | 339/103 R |
| 4,256,360 | 3/1981 | Debaigt | 339/97 R |
| 4,452,502 | 6/1984 | Forberg et al. | 339/99 R |

FOREIGN PATENT DOCUMENTS

| | | | |
|---|---|---|---|
| 2743242 | 3/1978 | Fed. Rep. of Germany | 339/97 R |

*Primary Examiner*—John McQuade
*Assistant Examiner*—Steven C. Bishop
*Attorney, Agent, or Firm*—Robert W. J. Usher; F. Brice Faller

[57] ABSTRACT

A one-piece wire stuffing cover having a series of tubular terminal receiving sockets with wire gripping slots at front and rear faces and respective wire stuffers between the slots, lead-out openings for wires terminated by the cover being provided in the sockets rearward of the wire stuffers. The lead-out openings are provided by rebated portions in the sockets which define wire engaging shoulders extending across a rear axial end of the terminal for strain relief. The slots in the rear face diverge progressively to release the wire at the rear face during termination.

9 Claims, 6 Drawing Figures

WIRE STUFFING COVER

The invention relates to a cover for a series of tubular terminals having respective axially extending wire receiving slots and to an electrical connector assembly including such cover.

Tubular terminals having respective axially extending wire receiving slots are being used with increasing frequency in electrical equipment in view of advantageous wire terminating characteristics, particularly in board mounted applications. In order speedily to terminate a wire in the terminal and to provide both insulation and strain relief in a single step, a cover which provides a wire stuffing function for a single wire has been proposed in U.S. Pat. No. 4,186,984.

The prior cover comprises a tubular portion moulded in one piece of resilient plastics material with a blind end adjacent a first face and an open, terminal receiving end at a second opposite face, a blind ended axially extending wire gripping slot opening to the open terminal receiving end, and an axially extending stuffer projecting internally from the blind end for engagement with a wire received in the slot when the cover is applied to the terminal. In use, a wire can be loaded into the cover to extend across the free end of the stuffer and the cover then applied to the terminal both to drive the wire into the terminal slot and insulate the terminal.

In the prior cover, the stuffer comprises a cylindrical block substantially filling the terminal interior preventing excess wire lead out from the terminal after termination. In consequence, either the wire must be accurately located in the cover adjacent its free end or the end of the wire must be severed during termination by the cover against a free rear edge of the terminal.

Manipulating the free end of a small wire for precise location in the cover can be a relatively laborious and time consuming operation, not facilitating economic mass production, and, furthermore, a possibility of tapping a wire intermediate its ends is obviated. The alternative of severing the wire against the free rear edge of the terminal impose an undesirable stress on a terminal supporting structure which may be relatively fragile, and is particularly unsuitable for simultaneous mass termination where the total severing forces would be very high.

It is an object of the invention to provide a cover which both provides an effective wire stuffing action and simultaneous mass termination.

According to the invention, a cover for a series of tubular terminals having respective axially extending wire receiving slots is moulded in one piece from resilient plastics material with a series of tubular sockets having blind ends adjacent a first face of the cover and terminal-receiving ends opening to a second, opposite face of the cover, pairs of aligned axially extending wire gripping slots and opening at one of their ends to the terminal-receiving face, being formed in respective socket walls at front and rear faces, stuffers projecting axially from the blind ends of respective sockets and wire lead out openings behind respective stuffers so that individual wires preloaded into respective pairs of wire gripping slots to extend across the respective stuffers will be forced into the wire receiving slots of the terminals when the cover is applied to the terminals with the free ends of the wires extending out of the sockets through the lead out apertures.

This permits wires quickly to be loaded into the cover while avoiding the time consuming manipulation of the wire ends. The exposed ends of the wires can readily be severed after termination and taps are also accommodated.

More particularly, a portion of the blind end of each socket located rearwardly of each stuffer is recessed to define each lead out opening.

Preferably, the recessed portion provides a wire engaging shoulder located to extend across a rear edge of the terminal. The wire may be gripped between the rear edge of the terminal and the shoulder to provide strain relief.

The slots formed at the rear face open at their other ends to the first face of the cover. Engagement of a wire with a rear wall portion of a terminal during movement of a stuffer into the terminal causes a free end of the wire to be bent so that an end portion upstands from the first face of the housing. This is facilitated by the wire gripping slots formed at the rear face of the cover increasing in width as they extend towards the first face, progressively releasing the wire as the cover is pressed home on the terminals.

The blind ended wire gripping slots formed at the front face of the cover may decrease in width as they extend towards the first face. Further strain relief may be provided by the wire gripping slots formed at the front face of the cover decreasing in width as they extend towards the first face and by providing a hemispherical stuffer which provides wire clearance between the stuffer and the rear wall of the terminal during insertion to prevent wire being drawn through the first wire gripping slot.

A known wire stuffing tool includes a cylindrical terminal receiving head with a single wire stuffer adapted to enter a tubular terminal formed with an axial wire-receiving slot. During insertion, the wire extends through a lead-out opening defined between the stuffer and the rear wall of the terminal and through a passageway in the tool shank. However, the tool head is made from rigid material and a wire must be preloaded into the head by threading into the passageway which is a time consuming step requiring that an end of the wire be free for the threading step. Clearly, the wire threading technique used in such tool would not be suitable for mass termination.

An example of a cover according to the invention will now be described with reference to the accompanying drawings in which:

FIG. 3 is a transverse cross-sectional view of the cover after wire termination;

Figure 1:
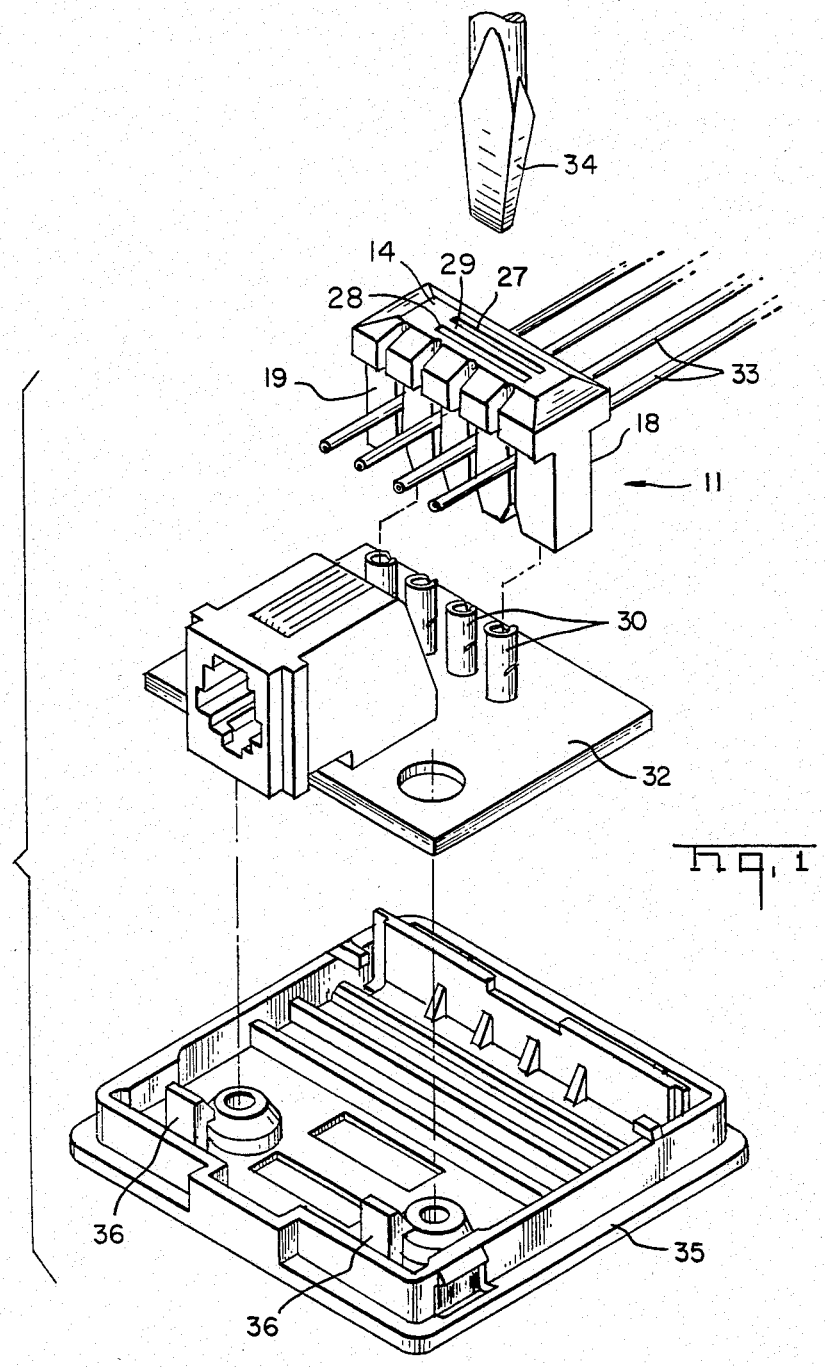
FIG. 1 is a perspective view of the cover loaded with wires and aligned for application to a series of terminals mounted in a board.

The cover 11 is moulded in one piece from resilient plastics material with a series of tubular sockets 12 having blind ends 13 adjacent a first face 14 of the cover and terminal receiving ends opening to an opposite, terminal receiving face 15 of the cover. Pairs of aligned first and second gripping slots 16 and 17, respectively, extend axially along respective opposite socket wall portions at front and rear faces 18 and 19, respectively of the cover and open at one of their longitudinal ends to the terminal receiving face 15.

The second slot 17 opens at its other longitudinal end 23 to the first face 14 of the cover. The first slot 16 decreases in width as it extends away from the face 14 and the slot 17 is formed with lips 25 which progressively diverge as they extend towards the first face 14 so that slot 17 progressively increases in width as it extends towards face 14 which progressively diminishes its wire gripping function in that direction.

Wire stuffers 20 project axially from blind ends 13 of respective sockets. Wire lead-out openings 21 are provided rearward of respective stuffers 20 and defined by a wire-engaging shoulder 22 recessed from blind end 13 and located to extend across a rear edge of a terminal 30 on termination.

The stuffers 20 are hemicylindrical having curved front faces and flat rear faces 24 extending to the shoulder 22. A first tool receiving slot 27 is formed in the cover to extend longitudinally of the first face 14 and a second longitudinally extending slot 28 is formed adjacent the first slot 27 to provide a resilient wall portion 29 between the slots 27, 28 which flexes to receive and grip a tool 34 inserted in the tool receiving slot 27.

In this particular example, the cover is used to insert wires 33 in tubular terminals 30 having axially extending slots 31, which terminals are mounted in a printed circuit board 32 of an electrical connector described in U.S. patent application No. 414,261, filed on Sept. 2, 1982, the disclosure of which is incorporated herein by reference. The connector comprises a base member 35 in which the circuit board is secured by latches 36 and a lid member 37 adapted to be secured to the base member 35 to clamp a cable therebetween subsequent to wire termination by the cover.

Figure 2:
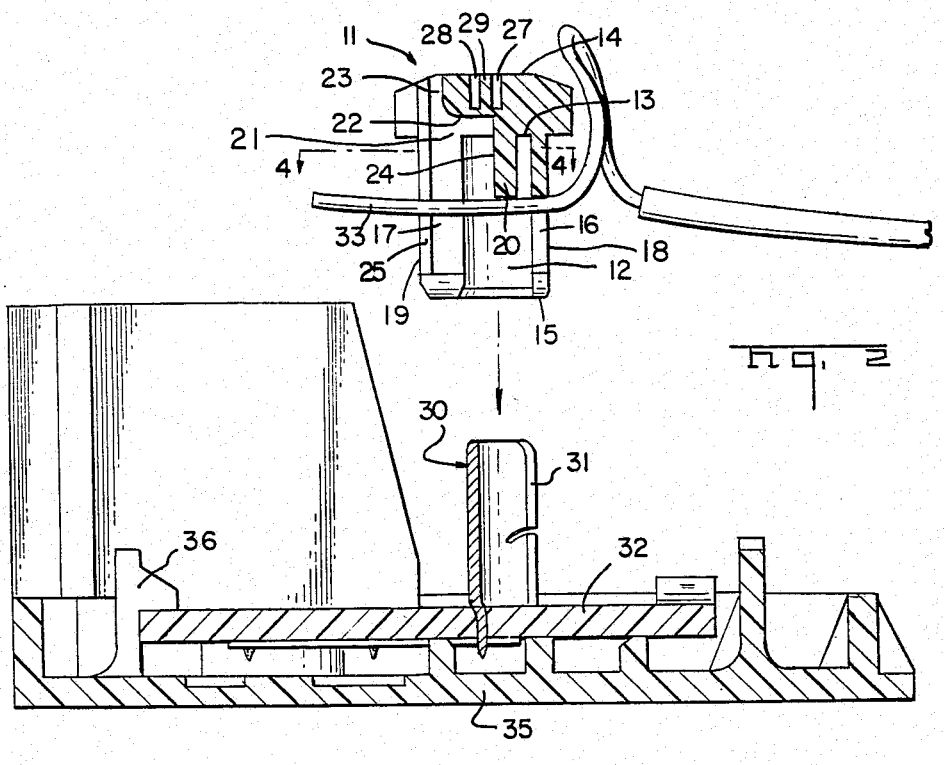
FIG. 2 is a transverse cross-sectional view of the cover of FIG. 1.
Figure 7:
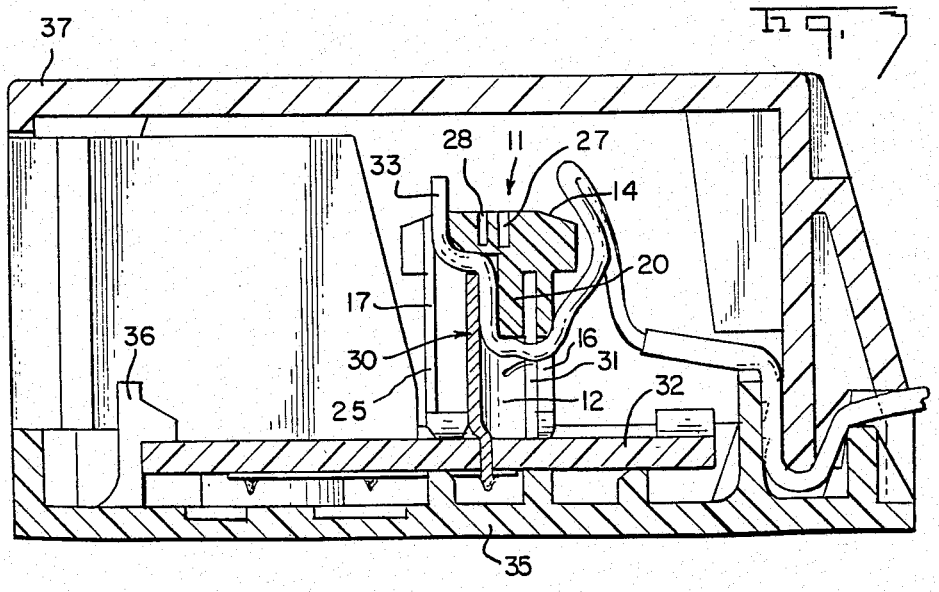
Figure 4:
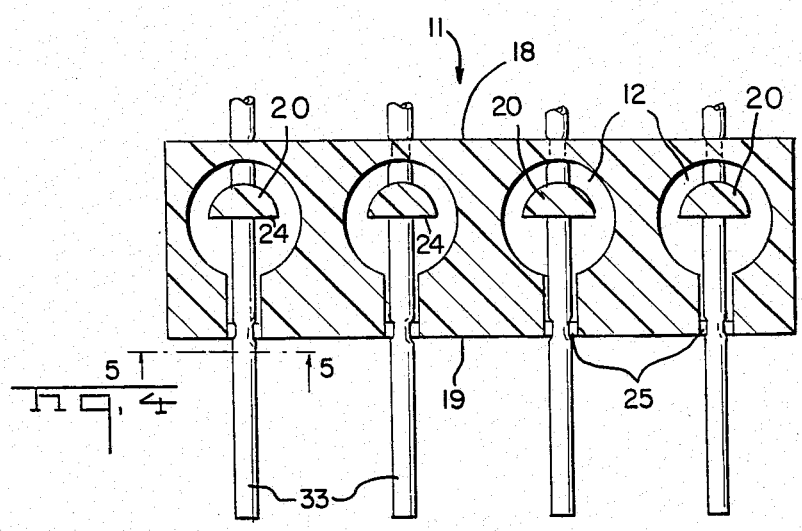
FIG. 4 is a longitudinal cross-sectional view taken along line 4—4 of FIG. 2.
Figure 5:
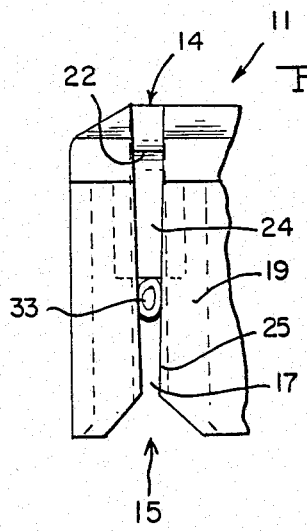
FIG. 5 is a fragmentary front elevational view taken along line 5—5 of FIG. 4.
Figure 6:
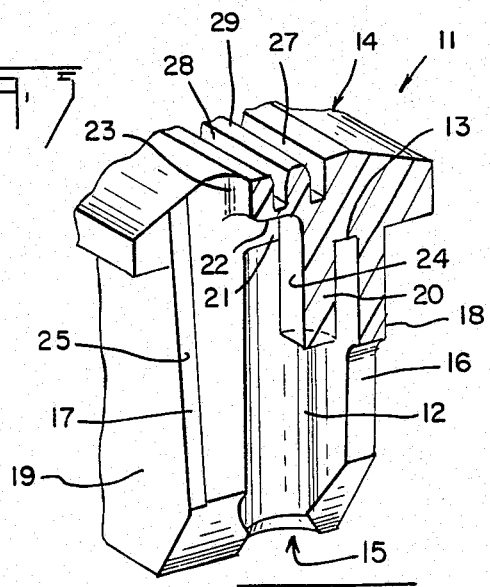
FIG. 6 is a fragmentary perspective view partly in cross-section taken along a socket axis.

In use of the cover, as shown in FIGS. 2 and 3, individual wires 33 are drawn intermediate their ends through the terminal receiving face 15 into respective wire gripping slots 16, 17 so that they extend across the free ends of respective stuffers 20. A suitable tool 34 is then inserted into the slot 27 and the cover is applied to all of the terminals 30 so that the wires are forced progressively into the terminal slots 31 by the stuffers and rear end portions of the wires are drawn progressively upward along respective slots 17 until released therefrom, facilitating their being drawn into the barrel and permitting them to spring up and extend through end 23 upstanding from the face 14. Strain relief is provided, particularly needed during subsequent severing of the wire ends, by the wire being clamped between the shoulder 22 and the rear edge of the terminal and between the face 24 of the stuffer and the rear wall of the terminal.

After termination, the upstanding end portions of the wires may readily be severed to minimum acceptable length. As the ends of the wires face upwardly, conductors are exposed to facilitate testing.

We claim:

1. A molded one piece resilient plastic cover for a tubular terminal having but one axially extending wire receiving slot comprises a socket profiled to closely receive the terminal, the socket having a blind end adjacent a first face of the cover and an opposed open end at a second, terminal receiving face of the cover, the cover having opposed front and rear faces extending between the first and second faces, an axially extending wire gripping slot in a socket wall at the front face and opening on the terminal receiving face, and a stuffer extending axially from the blind end of the socket for engagement with a wire when the cover is applied to a terminal, characterized by a second axially extending wire gripping slot formed in a socket wall at the rear face of the cover and opening on the terminal receiving face, the slot extending above the terminal when the cover is fully applied thereto, a wire lead-out opening communicating between the blind end of the socket behind the stuffer and the second axially extending wire gripping slot where it extends above the terminal when the cover is fully applied, the stuffer being profiled to permit the wire to be drawn into the terminal behind the stuffer as the cover is applied to the terminal to force the wire into the wire receiving slot thereof, whereby the wire will extend through the lead-out opening and out of the second wire gripping slot when the cover is fully applied.

2. A cover according to claim 1 in which a portiion of the blind end of the socket located rearwardly of the stuffer is recessed to define the lead-out opening.

3. A cover according to claim 2 in which the recessed portion provides a wire engaging shoulder located to extend across a rear axial end of the terminal.

4. A cover according to claim 2 in which the slot formed at the rear face extends to the first face of the cover.

5. A cover according to claim 4 in which the wire gripping slot formed at the rear face of the cover increases in width as it extends towards the first face.

6. A cover according to claim 4 in which the wire gripping slot formed at the front face of the cover decreases in width as it extends toward the first face.

7. A cover according to claim 1 in which the stuffer is hemicylindrical, a curved surface extending adjacent the front face.

8. A cover according to claim 1 in which a first tool-receiving slot extends longitudinally of the first face and a second slot extending adjacent the first slot to provide a resilient wall portion between the slots, which flexes to receive and grip a tool inserted in the first tool receiving slot.

9. A cover according to claim 1 wherein a series of such sockets are formed therein, the cover being directed to mass insertion of a parallel array of wires into a row of tubular terminals.

* * * * *